US007686003B2

(12) United States Patent
Witzigreuter

(10) Patent No.: US 7,686,003 B2
(45) Date of Patent: Mar. 30, 2010

(54) MANUALLY POWERED PROJECTILE LAUNCHER

(76) Inventor: John Witzigreuter, 600 Blackwater Ridge, Canton, GA (US) 30114

( * ) Notice: Subject to any disclaimer, the term of this patent is extended or adjusted under 35 U.S.C. 154(b) by 0 days.

(21) Appl. No.: 12/052,673

(22) Filed: Mar. 20, 2008

(65) Prior Publication Data

US 2009/0084372 A1 Apr. 2, 2009

Related U.S. Application Data

(60) Provisional application No. 60/995,540, filed on Sep. 27, 2007.

(51) Int. Cl.
*F41B 7/08* (2006.01)

(52) U.S. Cl. ..... 124/65

(58) Field of Classification Search ..... 124/63–69, 124/76, 73
See application file for complete search history.

(56) References Cited

U.S. PATENT DOCUMENTS

| | | | | | |
|---|---|---|---|---|---|
| 2,327,653 | A | | 8/1943 | Lisle | |
| 2,630,108 | A | * | 3/1953 | White | 124/65 |
| 2,780,213 | A | * | 2/1957 | Colling et al. | 124/75 |
| 3,765,396 | A | | 10/1973 | Kienholz et al. | |
| 4,565,183 | A | * | 1/1986 | Smith | 124/26 |
| 4,850,330 | A | * | 7/1989 | Nagayoshi | 124/76 |
| 4,881,517 | A | | 11/1989 | Wackrow et al. | |
| 5,058,561 | A | * | 10/1991 | Starr | 124/65 |
| 5,063,905 | A | | 11/1991 | Farrell | |
| 5,113,842 | A | | 5/1992 | Moormann | |
| 5,115,794 | A | * | 5/1992 | Moormann | 124/65 |
| 5,241,944 | A | * | 9/1993 | Rappaport | 124/67 |
| 5,267,549 | A | * | 12/1993 | Webber | 124/65 |
| 5,280,778 | A | * | 1/1994 | Kotsiopoulos | 124/73 |
| 5,349,938 | A | * | 9/1994 | Farrell | 124/73 |
| 5,377,656 | A | * | 1/1995 | Lewinski et al. | 124/65 |
| 5,497,758 | A | * | 3/1996 | Dobbins et al. | 124/76 |
| 5,553,598 | A | | 9/1996 | Johnson et al. | |
| 5,622,159 | A | * | 4/1997 | Liu et al. | 124/66 |
| 5,701,879 | A | * | 12/1997 | Johnson et al. | 124/69 |
| 5,735,256 | A | | 4/1998 | Monk | |
| 5,769,066 | A | | 6/1998 | Schneider | |
| 5,944,006 | A | | 8/1999 | Moore et al. | |
| 6,220,237 | B1 | * | 4/2001 | Johnson et al. | 124/73 |
| 6,343,598 | B1 | | 2/2002 | Pshenychny | |
| 6,405,722 | B2 | | 6/2002 | Colby | |
| 6,701,908 | B2 | * | 3/2004 | Nibecker, Jr. | 124/69 |
| 6,857,422 | B2 | | 2/2005 | Pedicini et al. | |
| 6,904,901 | B2 | | 6/2005 | Mitchell | |

(Continued)

*Primary Examiner*—Michael Carone
*Assistant Examiner*—Reginald Tillman, Jr.
(74) *Attorney, Agent, or Firm*—QuickPatents, Inc.; Kevin Prince

(57) ABSTRACT

The present device is a projectile launcher using compressed air. The device includes a barrel adapted to receive the projectile proximate a rear end. The device further includes a cylinder, a piston, and a firing handle fixed to a rear side of the piston. A valve provides selective fluid communication between the cylinder and the barrel. A bolt rod is fixed to the valve. The valve is actuated when the piston is pushed to a front end of the cylinder and the firing handle comes into contact with the bolt rod. Air compressed within the cylinder by the piston is thereby being released into the barrel to propel the projectile from the barrel. The barrel further includes a bolt slidable within the barrel between a loading position and a firing position. The bolt is fixed to the front end of the bolt rod and includes a bolt air passageway.

9 Claims, 3 Drawing Sheets

U.S. PATENT DOCUMENTS 6,986,343 B2 1/2006 Carnall et al.
7,150,276 B1 12/2006 Rice
7,156,084 B1 * 1/2007 Landis ..... 124/50
7,185,646 B2 * 3/2007 Jones ..... 124/74
2005/0115550 A1 6/2005 Jones
2007/0144506 A1 6/2007 Sun et al.

* cited by examiner

MANUALLY POWERED PROJECTILE LAUNCHER

CROSS-REFERENCE TO RELATED APPLICATIONS

This application claims the benefit of U.S. Provisional Patent Application 60/999,540, filed on Oct. 19, 2007, and incorporated herein by reference.

STATEMENT REGARDING FEDERALLY SPONSORED RESEARCH AND DEVELOPMENT

Not Applicable.

FIELD OF THE INVENTION

This invention relates to projectile launchers, and more particularly to compressed air projectile launchers.

BACKGROUND OF THE INVENTION

Compressed air projectile launchers are made to launch projectiles using compressed air as the source of launching force. The devices are used for launching a variety of projectiles ranging from toy projectiles, such as toy rockets, to ball type projectiles, such as paint balls. However, despite the development of many approaches to compressed air launchers, these approaches often have significant drawbacks.

Using compressed air is as a launching force provides many benefits. First, compressed air tends to be safer than using other sources of energy such as explosive sources of energy, like gun powder. Second, compressed air uses an inexpensive and readily available resource—air. Finally, using compressed air provides an easy way to control the force of the launch by controlling the force of the compression.

Many approaches have been developed to compressing air for compressed air projectile launchers. The simplest approach uses a tube, a piston, and a projectile. A projectile is placed snugly in one end of the tube and a piston in the other end. As the piston is pushed towards the projectile the air is compressed and will launch the projectile out of tube when the force of the compressed air is greater than the frictional force of the projectile against the tube. However, as sometimes it is desirable to launch the projectile with great force, other approaches have been developed.

One approach is compressing the air in advance by pumping compressed air into a chamber and then releasing the air at the desired time. However, this approach requires periodically re-pumping of the launcher, delaying the time between launches. In some situations, being able to launch projectiles quickly in rapid succession is important. One such situation is when playing the sport of paint ball. In this sport, opponents try to shoot each other with paint balls before their opponent does. Being able to shoot paint balls quickly in rapid succession can mean the difference between winning and losing. Therefore, a compressed air projectile launcher is needed that allows for repeated shooting without the need to pump the launcher multiple times in-between launches.

Another approach is to use compressed air canisters. Compressed air canisters are connected to the launchers and allow the launcher to be fired multiple times without needing to wait to recompress the air. However, these compressed air canisters have limited volumes and need to be replaced periodically. Replacing the canisters in the middle of a game will prevent the user from shooting, which is a disadvantage.

Therefore, a compressed air projectile launcher is needed that will not run out of its source of compressed air.

Thus, there is a need for a compressed air projectile launcher that can deliver a high level of force to shoot projectiles. Such a needed device would allow for repeated launches without the need to pump the launcher multiple times between launches. The needed device would further have an unlimited ability to provide compressed air to avoid running out of compressed air at an inconvenient time. The present invention accomplishes these objectives.

SUMMARY OF THE INVENTION

The present device is a device for launching a projectile using compressed air. The device includes a barrel having a front end and a rear end and adapted to receive the projectile proximate the rear end. The device further includes a cylinder, a piston, and a firing handle fixed to a rear side of the piston. A valve provides selective fluid communication between the cylinder and the barrel.

A bolt rod is fixed proximate a forward end thereof to the valve. A rear end of the bolt rod comes into contact with a surface of the firing handle when the piston is proximate the front end of the cylinder to actuate the valve. Air compressed within the cylinder by the piston is thereby being released into the barrel to propel the projectile from the barrel. In a preferred embodiment, the device further includes a forward handle fixed to the barrel, providing a handle to hold the device.

The barrel includes a projectile magazine open at a lower end thereof into the barrel proximate the rear end thereof. The barrel further includes a bolt slidable within the barrel proximate the rear end thereof between a loading position and a firing position. The bolt is fixed to the front end of the bolt rod and includes a bolt air passageway therethrough. When the bolt is in the firing position, the bolt seals the barrel from the projectile magazine. When the bolt is in the loading position, the bolt allows the projectile to fall from the projectile magazine into the barrel.

In a preferred embodiment, the valve is a plastic spool slidably captured on the bolt rod between a valve stop projecting laterally away from the bolt rod and the bolt. The firing handle is slidably captured on the rear end of the bolt rod with a handle stop projecting laterally away from the rear end of the bolt rod. The bolt further includes at least one elastomeric O-ring therearound. The valve also includes at least one elastomeric O-ring, the valve being maintained in a closed position by friction between the O-ring and the plastic spool.

The present device is a compressed air projectile launcher that can deliver a high level of force to shoot projectiles. The device also allows for repeated launches without the need to pump the launcher multiple times between launches. The present invention further has an unlimited ability to provide compressed air to avoid running out of compressed air at an inconvenient time. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
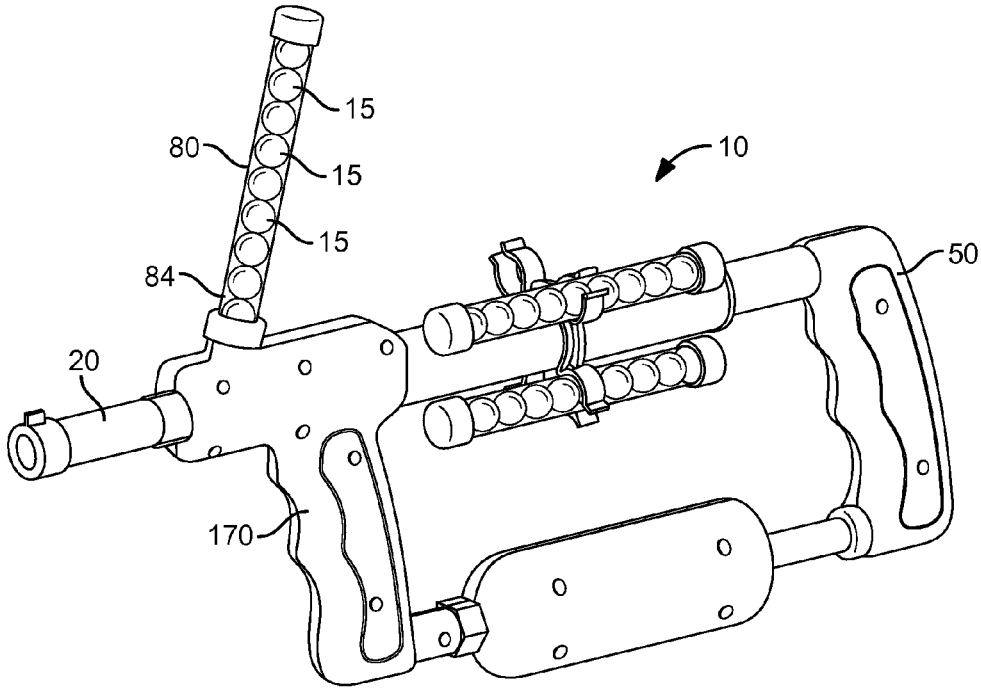
FIG. 1 is a perspective view of the invention, illustrating a projectile magazine with projectiles, a firing handle, and a forward handle.
Figure 2:
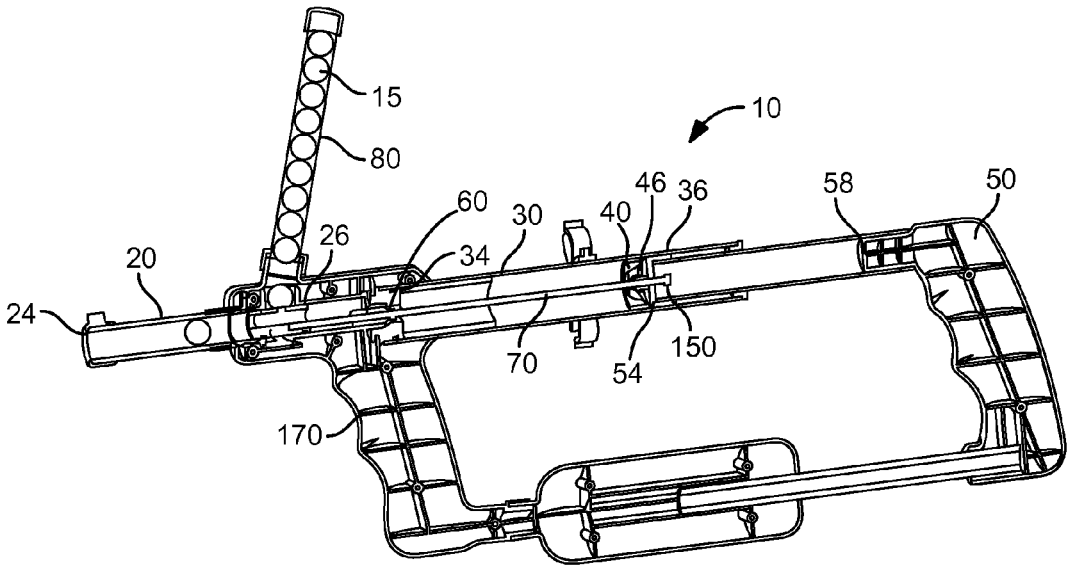
FIG. 2 is a cut-away side elevational view of the invention, illustrating positions of a barrel, a cylinder, a piston, a valve, a bolt rod, and a firing handle.
Figure 4:
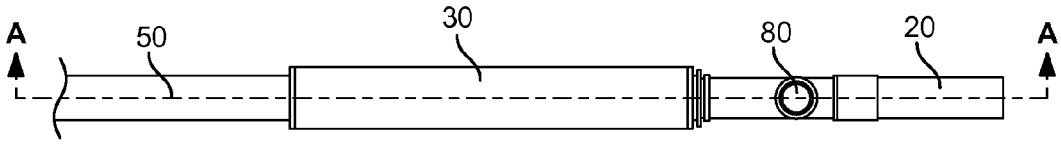
FIG. 4 is a top plan view of the invention, illustrating a firing handle, a cylinder, a projectile magazine, and a barrel.
Figure 5:
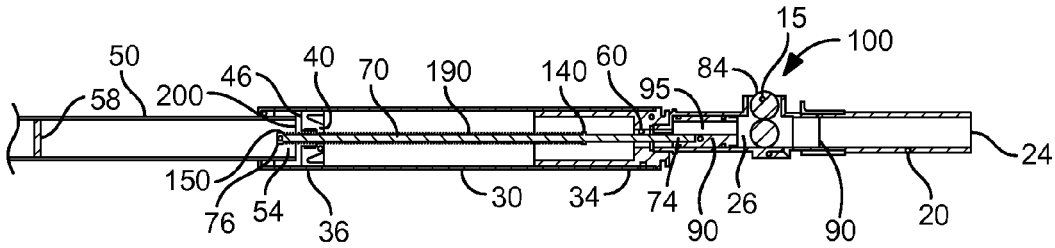
FIG. 5 is a cross-sectional view of the invention, taken generally along lines A-A of FIG. 4, illustrating an embodiment without a forward handle.

With respect to the drawings, FIG. 1 illustrates a device 10 for launching a projectile 15. In FIGS. 2 and 4, the device 10 includes a barrel 20 having a front end 24 and a rear end 26 and adapted to receive the projectile 15 proximate the rear end 26. Also in FIG. 2, a cylinder 30 has a front end 34 and a rear end 36. A piston 40 is confined between the front end 34 and rear end 36 of the cylinder 30. A firing handle 50 is fixed at a front end 54 thereof to a rear side 46 of the piston 40. In FIGS. 2 and 5, a valve 60 provides selective fluid communication between the cylinder 30 and the barrel 20. The device 10 is preferably made primarily from a light weight and durable material such as a rigid plastic material, but can also be formed from any suitable rigid material, such as metal, if desired.

Figure 3A:
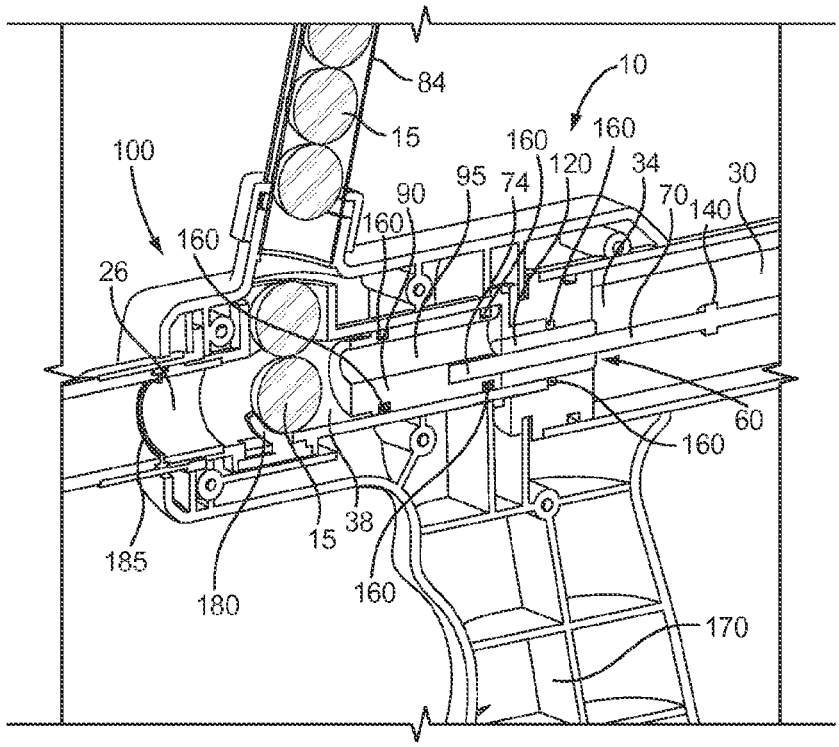
FIG. 3A is a cross-sectional view of the invention, taken generally along lines A-A of FIG. 4, illustrating the device in a loading position.
Figure 3B:
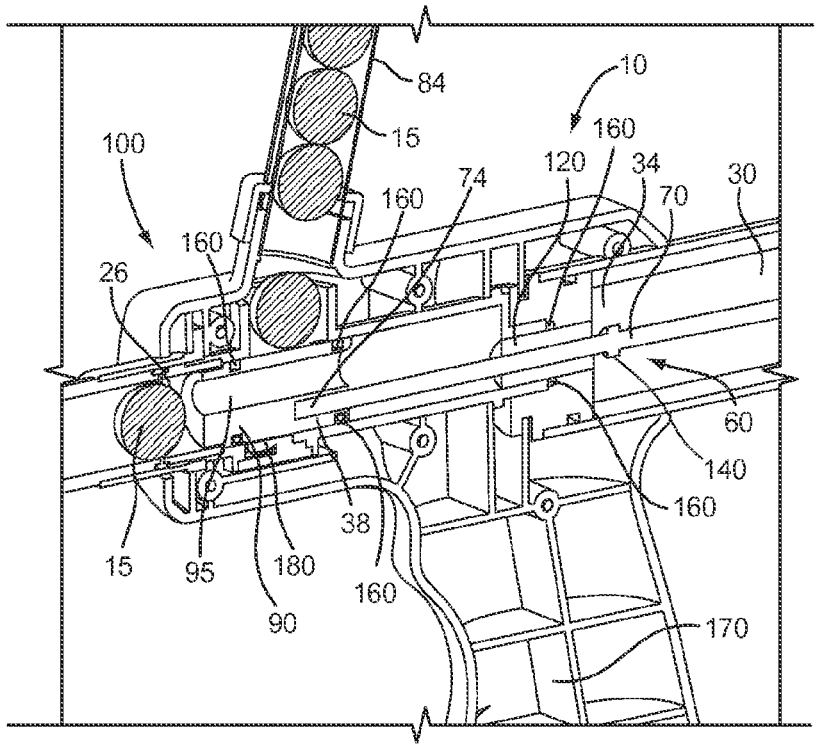
FIG. 3B is a cross-sectional view of the invention, taken generally along lines A-A of FIG. 4, illustrating the device in a firing position with the valve closed.

As illustrated in FIGS. 3A, 3B, and 5, a bolt rod 70 is fixed proximate a forward end 74 thereof to the valve 60. A rear end 76 of the bolt rod 70 approaches a surface 58 of the firing handle 50 when the piston 40 is pushed toward the front end 34 of the cylinder 30, compressing a forward return spring 190, in the preferred embodiment, and the air within the cylinder 30. When the air compressed within the cylinder 30 by the piston 40 reaches a predetermined pressure, the compressed air and the forward return spring 190 actuate the valve 60 and the compressed air is thereby released into the barrel 20 to propel the projectile 15 from the barrel 20, as illustrated in FIG. 3C.

In one embodiment, the bolt rod 70 projects through the cylinder 30. In another embodiment illustrated in FIGS. 1 and 2, the barrel 20 further includes a projectile magazine 80 open at a lower end 84 thereof into the barrel 20 proximate the rear end 26 thereof. As seen in FIG. 3A, the barrel 20 further includes a bolt 90 slidable within the barrel 20 proximate the rear end 26 thereof between a loading position 100 (FIG. 3A) and a firing position 110 (FIGS. 3B and 3C). The bolt 90 is fixed to the front end 74 of the bolt rod 70 and includes a bolt air passageway 95 therethrough, illustrated in FIG. 3A. When the bolt 90 is in the firing position 110, the bolt 90 seals the barrel 20 from the projectile magazine 80. When the bolt 90 is in the loading position 100, the bolt 90 allows the projectile 15 to fall from the projectile magazine 80 into the barrel 20.

Figure 3C:
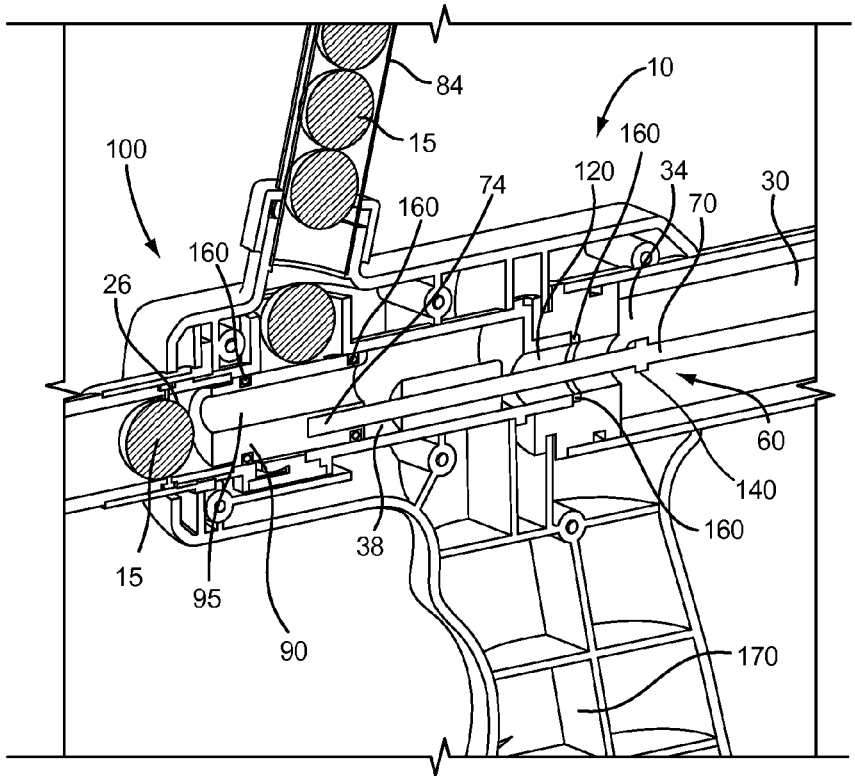
FIG. 3C is a cross-sectional view of the invention, taken generally along lines A-A of FIG. 4, illustrating the device in a firing position with the valve open.

In a preferred embodiment illustrated in FIGS. 3A-3C, the valve 60 is a plastic spool 120 slidably captured on the bolt rod 70 between a valve stop 140 projecting laterally away from the bolt rod 70 and the bolt 90. With the plastic spool 120 slidably captured on the bolt rod 70, the bolt rod can pass through the plastic pool 120 until the valve stop 140 comes into contact with the plastic spool 120. In FIGS. 2 and 5, the firing handle 50 is slidably captured on the rear end 76 of the bolt rod 70 with a handle stop 150 projecting laterally away from the rear end of the bolt rod 70. Illustrated in FIG. 3A, the bolt 90 further includes at least one elastomeric O-ring 160 therearound acting to prevent air pressure from escaping out through the projectile magazine 80 when the bolt 90 is in the firing position 110. Also in FIG. 3A, the valve 60 further includes at least one elastomeric O-ring 160, the valve 60 being maintained in a closed position by friction between the O-ring 160 and the plastic spool 120.

In a preferred embodiment, the device 10 further includes a forward handle 170 (FIGS. 1 and 2) fixed to the barrel 20. The forward handle 170 provides a handle to hold the device 10 when in use. In FIG. 3A, the device 10 further includes a projectile retainer 180, operative to prevent the projectile 15 from sliding through the barrel 20 when the bolt 90 is in the loading position 100. In another embodiment, illustrated in FIG. 3A, the barrel 20 further includes a projectile constrictor ring 185 to prevent the projectile 15 from sliding through the barrel 20 when the bolt 90 is in the firing position 110.

In another preferred embodiment, the bolt rod 70 includes the forward return spring 190 (FIG. 5) that urges the piston 40 towards the rear end 36 of the cylinder 30. The bolt rod 70 further includes a rear return spring 200 (FIG. 5) that urges the firing handle 50 towards the piston 40.

While a particular form of the invention has been illustrated and described, it will be apparent that various modifications can be made without departing from the spirit and scope of the invention. For example, the firing handle 50 can be slidably connected to the forward handle 170 providing additional structural support to the device 10. Also, the projectile magazine 80 can be removably attached so that additional projectiles 15 can be added quickly and easily. Accordingly, it is not intended that the invention be limited, except as by the appended claims.

What is claimed is:

1. A device for launching a projectile, comprising:

a barrel having a front end and a rear end and adapted to receive the projectile proximate the rear end;

a cylinder having a front end, a rear end and a volume of air therebetween;

a piston slidingly confined between the front and rear ends of the cylinder and sealingly trapping the volume of air;

a firing handle having a front end and a rear end, the front end thereof fixed to the piston, the firing handle facilitating compression of the volume of air by the application of manual pressure in a pushing stroke to the piston;

a valve providing selective fluid communication between the cylinder and the barrel; and a bolt rod fixed proximate a forward end thereof to the valve, the bolt rod actuating the valve by advance of the stroke to release the volume of air compressed by the piston as the piston approaches the front end of the cylinder-thereby to propel the projectile from the barrel, the bolt rod projecting through the cylinder slidingly threading the piston and the front end of the firing handle to make contact with the rear end of the firing handle, the contact resulting in actuation of the valve.

2. A device for launching a projectile, comprising:

a barrel having a front end and a rear end and adapted to receive the projectile proximate the rear end, a cylinder having a front end, a rear end and a volume of air therebetween;

a piston slidingly confined between the front and rear ends of the cylinder and sealingly trapping the volume of air;

a firing handle having a front end and a rear end, the front end thereof fixed to the piston, the firing handle facilitating compression of the volume of air by the application of manual pressure in a pushing stroke to the piston;

a valve providing selective fluid communication between the cylinder and the barrel; and a bolt rod fixed proximate a forward end thereof to the valve, the bolt rod actuating the valve by advance of the stroke to release the volume of air compressed by the piston as the piston approaches the front end of the cylinder-thereby to propel the projectile from the barrel;

the barrel further including a projectile magazine open at a lower end thereof into the barrel proximate the rear end thereof, the barrel further including a bolt slidable within the barrel proximate the rear end thereof between a loading and a firing position, the bolt fixed to the front end of the bolt rod and including a bolt air passageway therethrough, wherein the bolt in the firing position seals the barrel from the projectile magazine, and wherein the bolt in the loading position allows the projectile to fall from the projectile magazine into the barrel.

3. The device of claim 2 wherein the valve is a plastic spool slidably captured on the bolt rod between a valve stop projecting laterally away from the bolt rod and the bolt.

4. The device of claim 1 wherein the firing handle is slidably captured on the rear end of the bolt rod with a handle stop projecting laterally away from the rear end of the bolt rod, the handle stop acting to close the valve after the cylinder refills with air during a pulling stroke of the firing handle, the pulling stroke resetting the device for the next launch.

5. The device of claim 2 wherein the bolt further includes at least one elastomeric O-ring therearound.

6. The device of claim 3 wherein the valve further includes at least one elastomeric O-ring, the valve being maintained in a closed position by friction between the O-ring and the plastic spool.

7. The device of claim 2 further including a projectile retainer, operative to prevent the projectile from sliding through the barrel when the bolt is in the loading position.

8. The device of claim 2 wherein the barrel further includes a projectile constrictor ring to prevent the projectile from sliding through the barrel when the bolt is in the firing position.

9. A device for launching a projectile, comprising:

a barrel having a front end and a rear end and adapted to receive the projectile proximate the rear end;

a cylinder having a front end, a rear end and a volume of air therebetween;

a piston slidingly confined between the front and rear ends of the cylinder and sealingly trapping the volume of air;

a firing handle having a front end and a rear end, the front end thereof fixed to the piston, the firing handle facilitating compression of the volume of air by the application of manual pressure in a pushing stroke to the piston;

a valve providing selective fluid communication between the cylinder and the barrel; and a bolt rod fixed proximate a forward end thereof to the valve, the bolt rod actuating the valve by advance of the stroke to release the volume of air compressed by the piston as the piston approaches the front end of the cylinder-thereby to propel the projectile from the barrel, the bolt rod further including a forward return spring that urges the piston towards the rear end of the cylinder.

* * * * *